United States Patent [19]

Pasold

[11] 4,190,874

[45] Feb. 26, 1980

[54] ANTI-STATIC DEVICE FOR CLOTHES DRYERS

[76] Inventor: Raymond Pasold, 5412 N. Sawyer, Chicago, Ill. 60616

[21] Appl. No.: 917,452

[22] Filed: Jun. 21, 1978

[51] Int. Cl.[2] ..... H05F 3/00

[52] U.S. Cl. ..... 361/212; 34/1; 34/133; 361/220

[58] Field of Search ..... 361/212, 220; 34/1, 34/133; 366/57

[56] References Cited

U.S. PATENT DOCUMENTS

| | | | |
|---|---|---|---|
| 2,568,068 | 9/1951 | Harpman | 361/222 |
| 3,161,479 | 12/1964 | Biderman | 361/212 X |
| 3,197,885 | 8/1965 | Smith | 34/133 X |
| 3,713,280 | 1/1973 | Keller et al. | 361/220 X |
| 3,723,811 | 3/1973 | Koeleveld et al. | 361/220 X |
| 3,768,227 | 10/1973 | Grisell | 361/212 X |
| 3,991,479 | 11/1976 | Dionne | 361/212 X |

*Primary Examiner*—Harry E. Moose, Jr.

[57] ABSTRACT

An electrical conductive member is attached to the clothes tumbling vanes of a rotary clothes dryer in a manner to induce electrical current flow in the drying tumbling clothes to neutralize the frictionally created static electricity therein.

4 Claims, 3 Drawing Figures

ANTI-STATIC DEVICE FOR CLOTHES DRYERS

SUMMARY OF THE INVENTION

Static electricity is created through friction and as such it induces opposite electrical charges between the frictional pieces.

When clothes are dried in a rotary clothes dryer the tumbling action of the clothes causes enough friction therebetween to induce appreciable charges of static electricity in the clothes. The static electricity is of opposite charges and therefore the clothes tend to stick to each other making it difficult to separate the clothes upon removal from the clothes dryer.

The static charges are not known to be harmful, but they are a noticeable problem and it is highly desirable to provide a simple means of neutralizing the static charges before the clothes are removed from the dryer.

In the past devices such as magnets have been placed within the clothers dryer so that the magnetic field thereof will neutralize the static charges in the clothes. The magnetic field causes electrical currents to be induced within the clothes thereby neutralizing the static charges. Such a device is disclosed in U.S. Pat. No. 3,991,479. Other patents such as U.S. Pat. No. 3,161,479 disclose circuitry which provides an electrical pickup physically connected to a grounding element.

Other devices for preventing static charges in clothes dryers are shown in U.S. Pat. Nos. 2,568,068 and 2,975,528.

Although the above-described anti-static circuits and devices are usable in rotary clothes dryers, they are relatively complex and costly and require substantial modification in the dryer structure. These modifications are not within the realm of knowledge and especially of the normal user of the clothes dryer and are therefore not readily commercially available.

An object of the present invention is to provide an easily connected highly electrical conductive member to the tumbling vanes of a rotary-type clothes dryer. There is no requirement for the use of tools or is the member required to be fastened to the vanes by extra means such as nuts, bolts, screws, and the like. Such member is preferably made of copper and is so constructed that it may be clipped upon the tumbling vanes of the dryer in a position where it will be in constant contact with the drying clothes during their period of frictional engagement with each other. The member will actively induce electrical motion between the clothes so as to change the status of the static electricity, thus preventing a build-up of opposite electrical charges in such clothes, preventing the attraction therebetween.

As the clothes tumble in the dryer drum they will constantly move into contact with the conductive member and the resulting relative motion of the molecules which make up the clothes will cause a current to be induced between such clothes and the conductor which will neutralize the static charges, in the manner of a brush discharge effect.

DESCRIPTION OF THE DRAWINGS

The invention will be best understood by reference to the accompanying drawing, which shows a preferred mode of construction by which the objects of the invention are achieved and in which.

GENERAL DESCRIPTION

Figure 1:
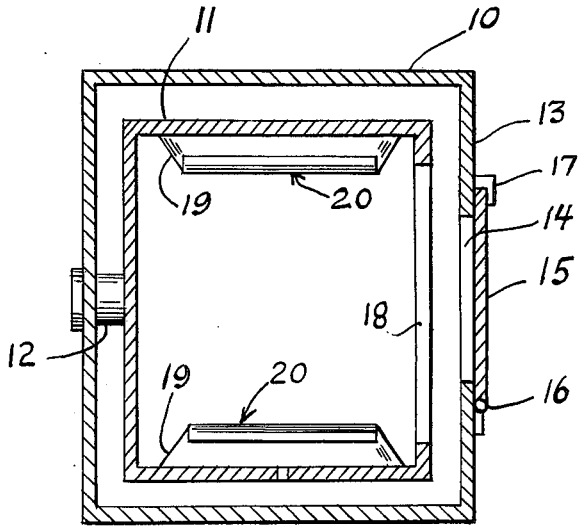
FIG. 1 is a side sectional view of a rotary clothes dryer.

In order to fully explain and demonstrate the function of the invention, a clothes dryer is represented schematically in FIG. 1, and includes a housing 10 which contains a rotatable drying drum 11 supported upon a driven rotatable shaft 12. The front wall 13 of the housing 10 provides an opening 14 normally closed by a door 15 carried by a suitable hinge arrangement 16 and which includes a manual latch 17.

The drum 11 provides a front wall opening 18 which is in alignment with the opening 14 formed in the front wall 13 of the housing 10 which provides access to the interior of the drum 11.

Formed as an integral part of the drum 11 are a series of tumbler vanes 19. These vanes 19 may be of any configuration, but normally are triangular and cross section so as to provide a narrow interior edge projecting inwardly of the drum 11.

Figure 2:
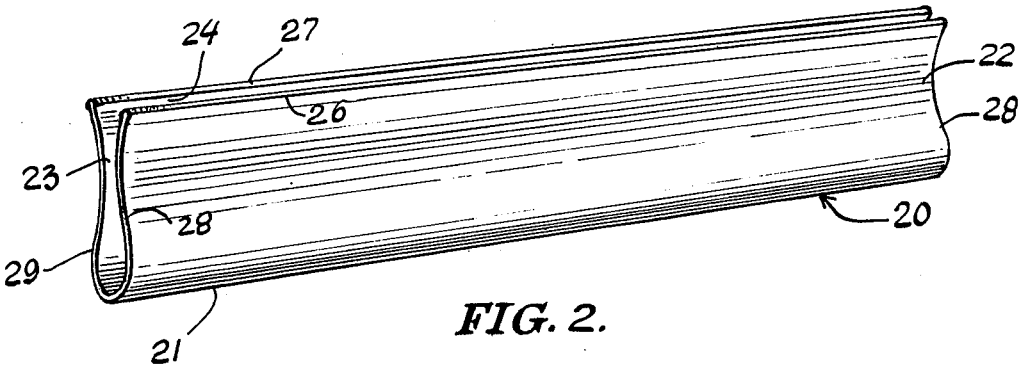
FIG. 2 is a perspective view of the anti-static device of the invention.

The anti-static member of this invention is shown in perspective in FIG. 2 and consists of a metallic body 20 preferably formed from a copper material. The body is generally U-shaped and provides an enlarged bite portion 21 of a general semi-circular configuration which terminates into concaved arm portion 22 and 23. The free ends of the arm portions 22 and 23 are slightly flared by reason of the concave curvature of the arms so as to form a mouth 24 which extends throughout the longitudinal length of the member 29 as shown.

Figure 3:
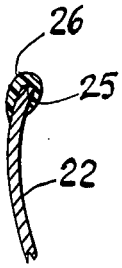
FIG. 3 is a fragmentary detailed sectional view of a portion of the anti-static device of the invention.

Referring to FIG. 3, it is shown that the free edges 25 of the arm 22 have a protective edge covering 26 formed from a plastic material, it being understood that the free edge of the arm 23 is likewise provided with a plastic edge cover 27 as shown in FIG. 2.

It should also be noted that if the opposite ends 28 and 29 of the arms 22 and 23 are desired to be shielded, they too may be covered with a plastic edging without departing from the spirit and intention of the invention.

Each of the tumbling vanes 19 will frictionally receive the anti-static member 20 as shown schematically in FIG. 1. The longitudinal length of the members 20 are such so as to substantially cover the exposed edge of the tumbling vanes 19 for a purpose hereinafter more fully described.

As the clothes are tumbled within the dryer 10 they will frictionally rub against each other so as to create static electrical charges therein. These static electrical charges consist of either a surplus or a deficiency of electrons in the molecules that make up the charged material. A different charge is created within the clothes particles and therefore create an attraction between the charged articles. To prevent the static charge from remaining in the clothes as they are dried and tumbled the anti-static member 20 of this invention will be caused to pass through such clothes and to act in the manner of a brush discharge. The member 20 being formed of copper with a highly conductive ability changes the electrical charges from static to that of motion, and as such dissipates the attraction between the clothes articles, which is the desired result.

The anti-static member 20 because of its independence from other metallic or electrical components of the dryer will not create an adverse charged condition nor will it be deterimental to the dryer or the clothes dried therein. It will retain its capacity to induce current flow through the clothes so as to dissipate the static electrical charges over an extremely long period of time without replacement or discharging.

While I have illustrated and described the preferred form of construction for carrying my invention into effect, this is capable of variation and modification without departing from the spirit of the invention. I, therefore, do not wish to be limited to the precise details of construction as set forth, but desire to avail myself of such variations and modifications as come within the scope of the appended claims.

Having thus described my invention what I claim as new and desire to protect by Letters Patent is:

1. An anti-static device for use in rotary clothes dryers having a rotatable drying drum including tumbler vanes by which clothes are tumbled in heated air comprising:

(a) a conductive member mounted upon the tumbler vanes of the clothes drying drum for contracting the clothes as they are tumbled thereby so as to induce electrical current in the clothes thereby neutralizing static elecrical charges developed therein by friction therebetween.

2. An anti-static device as defined by claim 1 wherein said conductive member provides means for removable connection to the tumbler vanes of the rotatable drying drum.

3. An anti-static device as defined by claim 1 wherein said conductive member is preferably formed from a substantial U-shaped copper sheet and adapted to be positioned upon the exposed edges of the tumbler vanes of the rotary clothes dryer.

4. An anti-static device as defined by claim 3 wherein said copper sheet provides means for removable connection to the tumbler vanes of the rotatable drying drum.

* * * * *